US011898470B2

(12) United States Patent
Edke et al.

(10) Patent No.: US 11,898,470 B2
(45) **Date of Patent: *Feb. 13, 2024**

(54) CYLINDER DEACTIVATION AND ENGINE BRAKE MECHANISM FOR TYPE III CENTER PIVOT VALVETRAINS

(71) Applicant: Eaton Intelligent Power Limited, Dublin (IE)

(72) Inventors: Pritam Gopal Edke, Pune (IN); Nikhil Saggam, Pune (IN); Nicola Andrisani, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 18/318,884

(22) Filed: May 17, 2023

(65) Prior Publication Data

US 2023/0296036 A1 Sep. 21, 2023

Related U.S. Application Data

(63) Continuation of application No. 17/620,510, filed as application No. PCT/EP2020/025291 on Jun. 17, 2020, now Pat. No. 11,686,224.

(30) Foreign Application Priority Data

Jun. 20, 2019 (IN) ..... 201911024473

(51) Int. Cl.
*F01L 1/18* (2006.01)
*F01L 13/06* (2006.01)
(Continued)

(52) U.S. Cl.
CPC ..... *F01L 1/181* (2013.01); *F01L 13/065* (2013.01); *F01L 1/22* (2013.01); *F01L 1/267* (2013.01);
(Continued)

(58) Field of Classification Search
CPC ... F01L 1/181; F01L 1/22; F01L 1/267; F01L 1/46; F01L 13/0005; F01L 2013/001; F01L 13/06; F01L 13/065
(Continued)

(56) References Cited

U.S. PATENT DOCUMENTS 4,222,354 A 9/1980 Uitvlugt
4,227,494 A 10/1980 Uitvlugt
(Continued)

FOREIGN PATENT DOCUMENTS

CN 201953428 U 8/2011
CN 107939472 A 4/2018
(Continued)

OTHER PUBLICATIONS

International Search Report and Written Opinion dated Jul. 30, 2020 for International Application No. PCT/EP2020/025291, 12 pages.

*Primary Examiner* — Jorge L Leon, Jr.
(74) *Attorney, Agent, or Firm* — Baker Botts L.L.P.

(57) ABSTRACT

A rocker assembly for a type III center pivot valvetrain comprises a rocker arm having a cam end, a center pivot bore, and a valve end which includes a first actuator bore and a second actuator bore. The rocker assembly further comprises a cylinder deactivation actuator arranged in the first actuator bore. The cylinder deactivation actuator comprises a hydraulically actuated latch assembly configured to selectively switch between a latched configuration and an unlatched configuration and a mechanical lash-setting sleeve distanced from a travel stop defined within the first actuator bore. The cylinder deactivation actuator further comprises a latch step disposed below the mechanical lash-setting sleeve and extending into the first actuator bore. The hydraulically actuated latch assembly is configured to selectively travel between the travel stop and the latch step when the hydrau-
(Continued)

lically actuated latch assembly is in the latched configuration.

10 Claims, 17 Drawing Sheets

(51) Int. Cl.

| | |
|---|---|
| *F01L 13/00* | (2006.01) |
| *F01L 1/26* | (2006.01) |
| *F01L 1/46* | (2006.01) |
| *F01L 1/22* | (2006.01) |

(52) U.S. Cl.
CPC ..... *F01L 1/46* (2013.01); *F01L 13/0005* (2013.01); *F01L 2013/001* (2013.01)

(58) Field of Classification Search
USPC ..... 123/90.16, 90.4, 90.44, 90.45
See application file for complete search history.

(56) References Cited

U.S. PATENT DOCUMENTS

| | | | | |
|---|---|---|---|---|
| 4,387,680 | A | 6/1983 | Tsunetomi | |
| 4,556,025 | A | 12/1985 | Morita | |
| 5,992,360 | A | 11/1999 | Elendt | |
| 2016/0281612 | A1* | 9/2016 | Toth | F01L 1/18 |
| 2018/0187579 | A1 | 7/2018 | Cecur | |
| 2018/0371961 | A1* | 12/2018 | Bogdanski | F01L 1/181 |
| 2019/0010835 | A1 | 1/2019 | McCarthy | |
| 2020/0182108 | A1 | 6/2020 | Vanwingerden | |
| 2020/0224559 | A1 | 7/2020 | McCarthy | |

FOREIGN PATENT DOCUMENTS

| | | | |
|---|---|---|---|
| DE | 19608651 | A1 | 9/1997 |
| DE | 19914046 | A1 | 9/2000 |
| EP | 2444602 | A1 | 4/2012 |
| EP | 2902596 | A1 | 8/2015 |
| EP | 3418513 | A1 | 12/2018 |
| JP | 5530930 | U | 2/1980 |
| WO | WO 2016207348 | A1 | 12/2016 |
| WO | WO 2017160379 | A1 | 9/2017 |
| WO | WO 2019036272 | A1 | 2/2019 |

* cited by examiner

CYLINDER DEACTIVATION AND ENGINE BRAKE MECHANISM FOR TYPE III CENTER PIVOT VALVETRAINS

PRIORITY

This application is a continuation under 35 U.S.C. § 120 of U.S. patent application Ser. No. 17/620,510, filed 17 December 2021, now issued as U.S. Pat. No. 11,686,224 on 27 June 2023, which claims the benefit under 35 U.S.C. § 365(c) of International Patent Application No. PCT/EP2020/025291 , filed 17 June 2020, which claims the benefit under 35 U.S.C. § 119(a) of Indian Provisional Application No. 201911024473, filed 20 Jun. 2019, which are incorporated herein by reference.

FIELD

This application provides devices and systems for switching between nominal valve lift, engine braking, and cylinder deactivation on a type III center pivot valvetrain.

BACKGROUND

A long felt need is to have technology that enables multiple functions on a single cylinder of an engine. Control on a cylinder-to-cylinder and cycle-to-cycle basis is desired. The functionality must be reliable. Ordinarily, to have engine braking, a separate rocker arm is used so that one rocker arm applies one valve lift profile while the second rocker arm applies the engine braking lift profile.

SUMMARY

The methods and devices disclosed herein overcome the above disadvantages and improves the art by way of a rocker assembly comprising multiple functions. A rocker assembly for a type III center pivot valvetrain comprises a rocker arm comprising a cam end, a center pivot bore, and a valve end. The valve end comprises a first actuator bore and a second actuator bore. A cylinder deactivation actuator is in the first actuator bore. An engine brake actuator is in the second actuator bore. The rocker assembly can be part of a valve assembly and can impart an engine braking function, a cylinder deactivation function, and a main lift function to first and second valves. It is also possible to impart an early exhaust valve opening, a main lift function, and a late exhaust valve closing to the engine braking valve.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

Figure 1A:
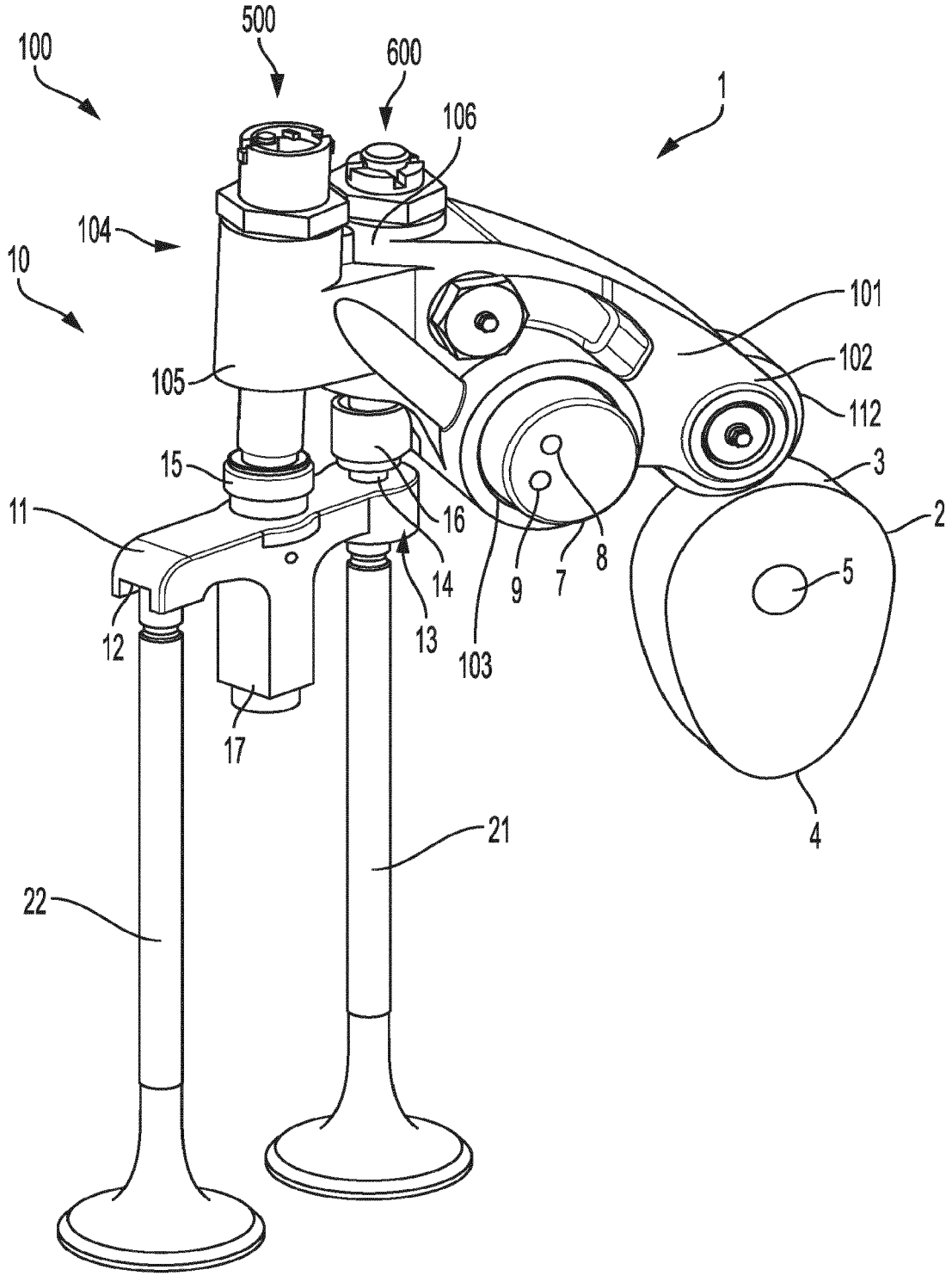
FIG. 1A is a view of a valve actuation assembly including a rocker assembly.
Figure 1B:
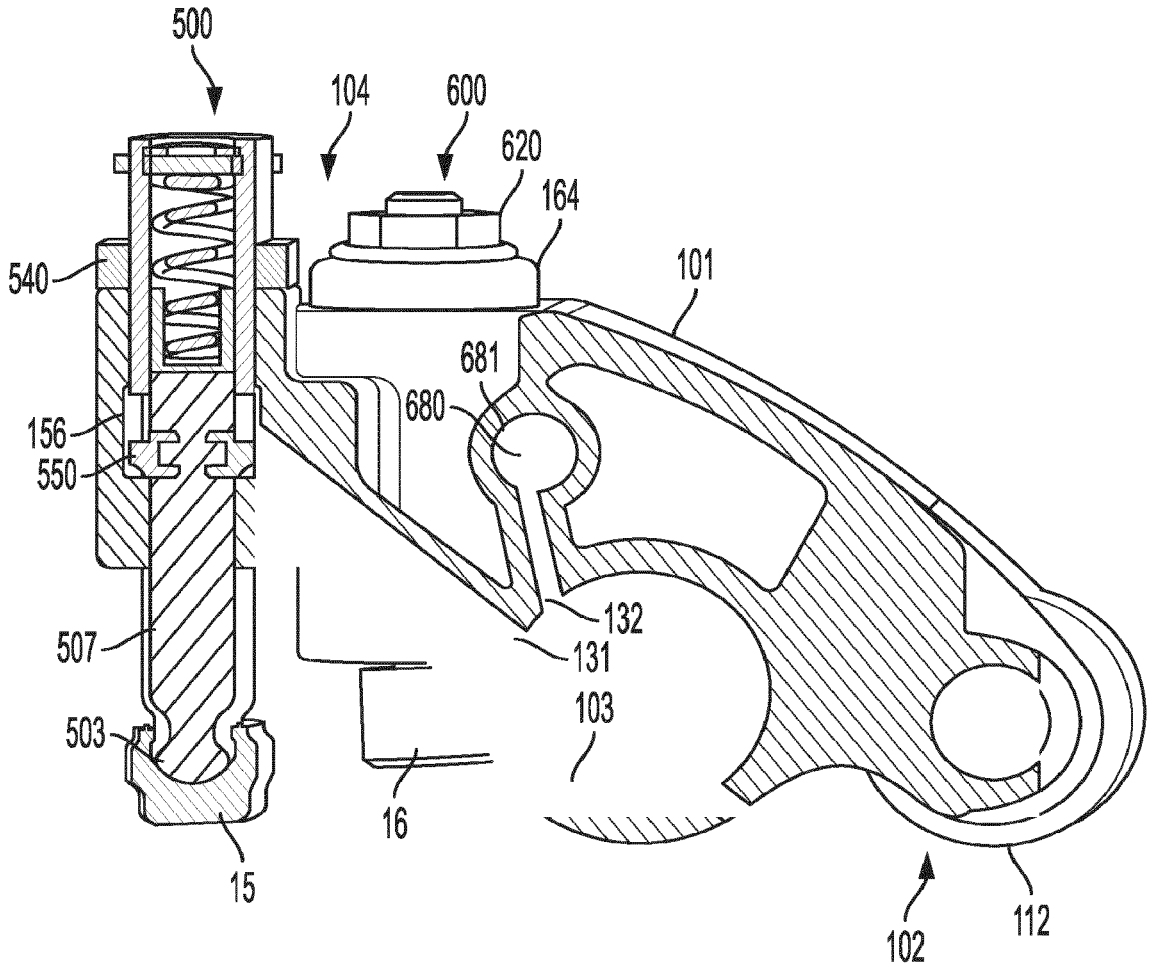
FIG. 1B is a cross-section view of the rocker assembly.

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures.

An integrated design for a valve assembly 10 achieves cylinder deactivation ("CDA") function and decompression engine braking ("EB") function for a type III center pivot valvetrain 1 in a single rocker arm 101. CDA can reduce greenhouse gas and improve fuel economy. And, it can be used for exhaust thermal management. The rocker arm 101 integrates a CDA actuator 500 with an engine brake actuator 600.

A rocker assembly 100 for a type III center pivot valvetrain 1 comprises a rocker arm 101 comprising a cam end 102, a center pivot bore 103, and a valve end 104. The cam end 102 can comprise a roller 112 or other tappet, such as a slider pad. The valve end comprises a first actuator bore 105 and a second actuator bore 106. A cylinder deactivation actuator 500 is in the first actuator bore 105. An engine brake actuator 600 is in the second actuator bore 106.

The rocker assembly 100 can be part of a valve assembly 10 that can be distributed on a valvetrain 1 to impart an engine braking function, a cylinder deactivation function, and a main lift function to corresponding first and second valves 21, 22 in the valvetrain. It is also possible to impart an early exhaust valve opening ("EEVO") function, a main lift function, and a late exhaust valve closing ("LEVC") function to the engine braking valve.

An engine system can comprise several cylinders for combustion. The cylinders can be acted upon by a valvetrain 1 that can comprise respective intake valves and respective first and second exhaust valves 21, 22, duplicated as necessary for each cylinder. At least one of the cylinders can comprise the valvetrain components shown in FIG. 1A. Other cylinders can comprise rocker arms that are configured differently to give the engine system more optional functions. A cam 2 on a rotatable cam rail 5 can rotate a base circle lobe profile 3 and a lift lobe profile 4 against the roller 112 on the cam end 102 to actuate the valves 21, 22 at the valve end 104 of the rocker arm 101. The valves 21, 22 can comprise customary features such as a head and a stem and various accompaniments can be included such as return springs and guides.

The valve end 104 can be configured to act on a valve bridge 11, as by footings 15, 16. Second valve 21 can be connected to a cleat 14 in a pass-through 13 in the valve bridge 11. The engine brake function can be imparted to the second valve 21 by moving the cleat 14 separately from the rest of the valve bridge 11. A second valve 22 can be seated on a seat 12 of the valve bridge 11. When the whole valve bridge is acted on, the second valve 22 can receive a main lift function and the valve bridge 11 can press the cleat 14 to impart the main lift function to the second valve 21. An optional guide 17 can be included on the valve bridge 11 with a corresponding alignment feature on the cylinder head of the engine.

The rocker assembly 100 further comprises a first hydraulic port 131 connected from the center pivot bore 103 to the first actuator bore 105 and a second hydraulic port 132 connected from the center pivot bore 103 to the second actuator bore 106. The first hydraulic port 131 can fluidly couple to a first fluid pathway 9 in the rocker shaft 7, which can in turn couple to a first oil control valve ("OCV") in a control circuit. The second hydraulic port 132 can fluidly couple to a second fluid pathway 8 in the rocker shaft 7, which can in turn couple to a second oil control valve in the control circuit. A rotation mechanism can be included to rotate the rocker shaft 7 to switch the first and second fluid pathways 9, 8 in and out of alignment with their respective first and second hydraulic ports 132, 132. Additional fluid pathways can be included in the rocker shaft 7, such as a return pathway. The first and second oil control valves can be controlled to supply high pressure hydraulic fluid to switch the CDA actuator 500 or EB actuator 600 as detailed more below.

The rocker assembly 100 can impart main lift function to the valves 21, 22 of valve bridge 11 as by control of the cylinder deactivation actuator 500 comprising a hydraulically actuated latch assembly 550. Selectively switching between latched and unlatched controls whether the rocker arm 101 transfers force from the cam end 102 through the valve end 104 or whether the force is lost in the motion of the unlatched hydraulically actuated latch assembly 550.

The CDA actuator 500 can comprise a plunger 501, a mechanical lash-setting sleeve 520, and a plunger spring 530. The plunger spring 530 can be held within the mechanical lash-setting sleeve 520 via a spring clip 526 in a groove 522. The groove 522 can be an internal groove, pass-through slot or other feature for terminating the mechanical lash-setting sleeve 520, such as a cap, screw, crimp, cleat, or the like. A spring cup 506 or other guide mechanism can guide the plunger spring 530 as a drop-in feature or extension of the plunger body 507. The plunger spring 530 can bias the plunger 501 in a direction out of the mechanical lash-setting sleeve 520 and towards the valve bridge 11. The plunger 501 can terminate with a knurl 503 that seats in footing 15. Footing can be an elephant foot ("e-foot") that allows a pivot joint and some relative motion between the plunger 501 and valve bridge 11. For example, the knurl 503 can rotate in the footing 15 while the footing 15 has a flat-on-flat position against the valve bridge 11.

The first actuator bore 105 can have features complementary to the CDA actuator 500. For example, in one alternative, the mechanical lash-setting sleeve can comprise an external thread 521 to couple with an internal thread 154 in the first actuator bore 105. Then, the location of the latch end 524 of the mechanical lash-setting sleeve 520 can be set with precision. With the plunger spring 530 abutting the spring end 523 of the mechanical lash-setting sleeve 520, the spring force can be set relative to the plunger body 507 and valves 21, 22.

The plunger 501 can comprise a portion that passes through plunger bore 151. A travel bore 156 can be included between the internal thread 154 and the plunger bore 151. A travel stop 152 can be in the form of a step or ledge in the travel bore 156. When the hydraulically actuated latch assembly 550 is latched, it cannot travel past the travel stop 152. A latch step 153, such as a lip, rim, or other protrusion can be formed at the limit of the internal thread 154. The latch step 153 can serve as a secondary travel limit for restricting the position of the hydraulically actuated latch assembly 550 within the travel bore 156. If extended into the travel bore 156, the mechanical lash-setting sleeve can instead serve as the secondary travel limit. So, it is possible to thread the mechanical lash-setting sleeve 520 to a depth within the travel bore 156 using features of threading in the first actuator bore 105. Additional positioning flexibility can be had by using lash nut 540, which can be threaded relative to the mechanical lash-setting sleeve 520 and top edge 155 of the first actuator bore 105 to secure the location of the mechanical lash-setting sleeve 520.

The plunger spring 530 biases the plunger 501 in a direction out of the mechanical lash-setting sleeve 520, and the hydraulically actuated latch assembly 550 is seated in the plunger 501. So, in a base circle, or unactuated position, the CDA actuator 500 is configured within the first actuator bore 105 so that the hydraulically actuated latch assembly 550 is pushed towards the travel stop 152.

Figure 4A:
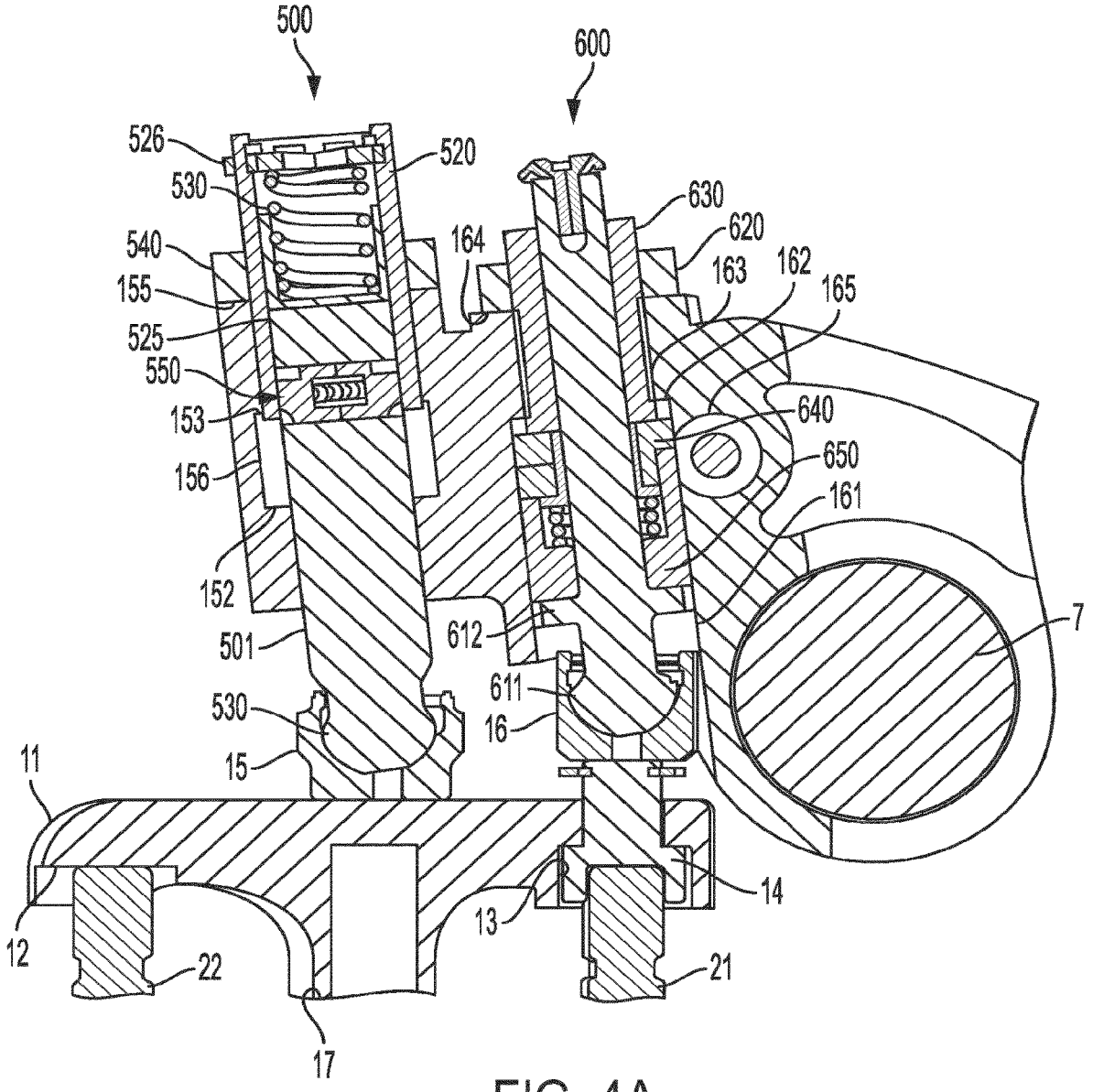
FIGS. 4A & 4B illustrate aspects of cylinder deactivation modes.
Figure 4B:
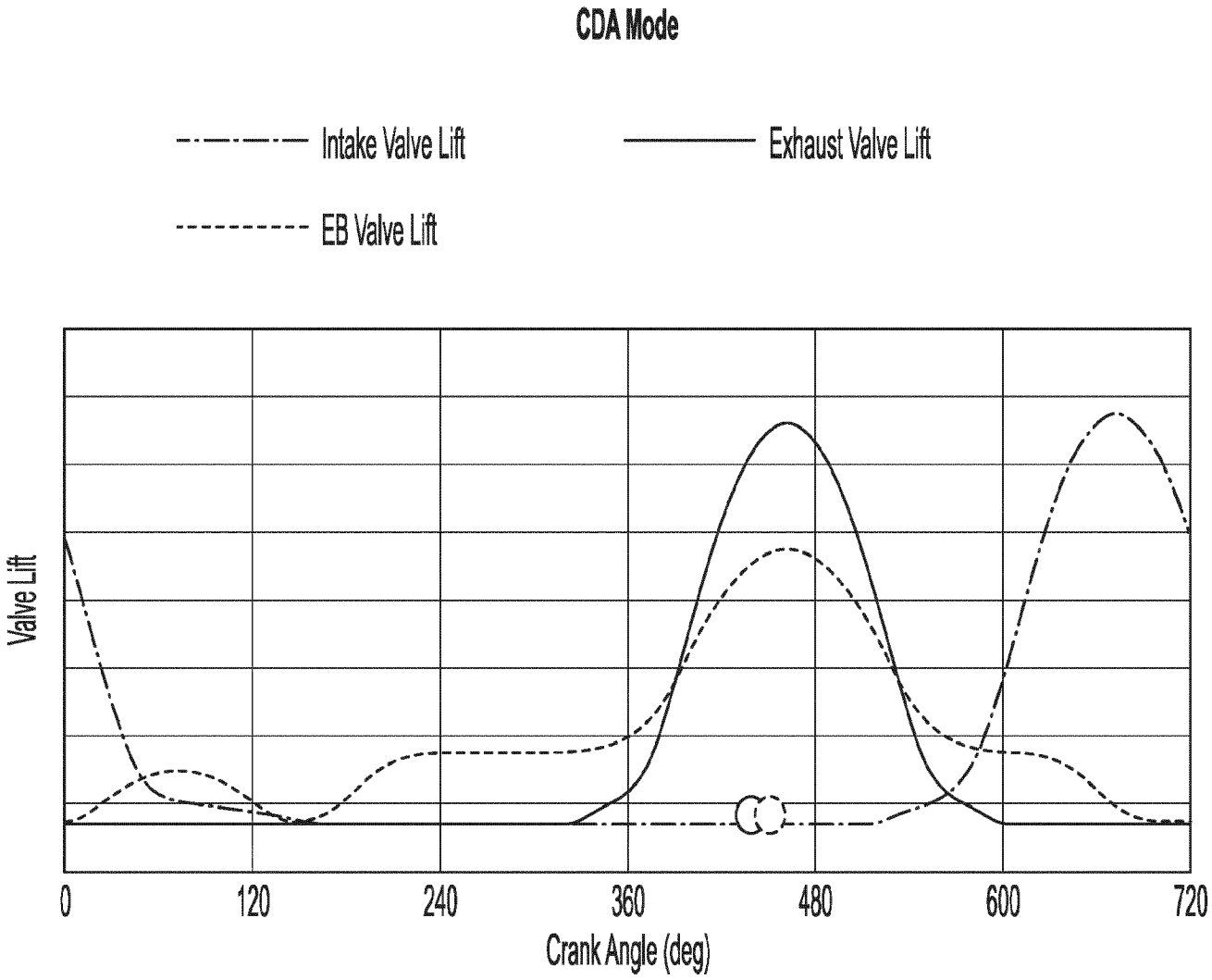

The hydraulically actuated latch assembly 550 comprises a pair of latch pins 551, each comprising a nose 552 and a spring bore 553. A latch spring 554 in the spring bores 553 pushes the noses 552 towards the internal wall of the travel bore 156. The noses 552 are configured so that they cannot move past the travel stop 152, latch step 153, or latch end 524 without receiving hydraulic pressure sufficient to collapse the latch pins 551 into the latch bore 502. As an example, if first oil control valve were controlled to send high pressure oil through the path 9 in the rocker shaft 7 to first hydraulic port 131, then the high pressure of the oil would enter the travel bore 156 and overcome the spring force of latch spring 554. With the correct timing, the latch pins 551 would collapse into the latch bore 502, then the lift lobe 4 would act on the cam end 102 to tip the valve end 104 towards the valves 21, 22, but latch pins 551 would travel into the mechanical lash-setting sleeve 520, as shown in FIG. 4A, and a cylinder deactivation function would occur. As shown by the circles in FIG. 4B, the second exhaust valve 21, also called the engine brake valve, would have zero lift while the latch pins 551 were so compressed. Likewise, the first exhaust valve 22, also called the main valve, would have zero lift. The EB Valve Lift (dashed line) and Exhaust Valve Lift (solid line) curves would not be followed.

As or before the cam 2 returns to base circle 3, the high pressure oil supply can be terminated by control of the OCV. The latch pins 551 can slide in the latch bore 502 once the plunger spring 530 pushes the plunger 501 far enough out of the mechanical lash-setting sleeve 520. The hydraulically actuated latch assembly 550 can again engage in the travel bore 156 until the high pressure oil is supplied again.

As will be explained in more detail, the hydraulically actuated latch assembly 550 travels in the travel bore 156 during the main lift function and engine brake function, also called the drive modes and engine braking modes. In the cylinder deactivation mode, the hydraulically actuated latch assembly 550 can be configured to travel out of the travel bore 156 into the mechanical lash-setting sleeve 520. The travel distance in the travel bore 156 is more than a mere latch clearance or tolerance between the noses 552 and travel stop 152, latch step 153 or latch end 524. The travel bore 156 provides a travel distance that enables the packaging and functionality of both cylinder deactivation and decompression engine braking in the same rocker arm 101. The travel distance of the travel bore 156 is sized to so that the engine brake valve 21 opens for engine braking while the hydraulically actuated latch assembly 550 is travelling in the travel bore 156. This keeps the main valve 22 from opening during the engine braking function until the timing set by the travel distance dictates that the main valve 22 open for its main lift function.

So, for the first actuator bore 105 comprising a travel stop 152, the mechanical lash-setting sleeve 520 is distanced from the travel stop 152 by a travel distance. And, the hydraulically actuated latch assembly 550 is configured in the first actuator bore 105 to selectively travel between the travel stop 152 and the mechanical lash-setting sleeve 520 when the hydraulically actuated latch assembly 550 is latched. In an alternative, when the latch step 153 acts as a secondary travel limit instead of the latch end 524, the hydraulically actuated latch assembly 550 is configured in the first actuator bore 105 to selectively travel between the travel stop 152 and the latch step 153 when the hydraulically actuated latch assembly 550 is latched.

Also, for the first actuator bore 105 comprising the travel stop 152, the mechanical lash-setting sleeve 520 is distanced from the travel stop 152 by a travel distance. And, the hydraulically actuated latch assembly 550 is configured in the first actuator bore 105 to selectively travel between the travel stop 152 and into the mechanical lash-setting sleeve 520 when the hydraulically actuated latch assembly 550 is unlatched. In an alternative, when the latch step 153 acts as a secondary travel limit instead of the latch end 524, and when the internal thread 154 is modified and configured to substitute for the mechanical lash-setting sleeve 520, the hydraulically actuated latch assembly 550 is configured in the first actuator bore 105 to selectively travel between the travel stop 152 and past the latch step 153 when the hydraulically actuated latch assembly 550 is unlatched. The hydraulically actuated latch assembly 550 can travel into the mechanical lash-setting sleeve 520 or into the modified internal thread area.

The engine brake actuator 600 in the second actuator bore 106 can be a hydraulically actuated castellation assembly 601. It can be configured to selectively switch between a lost motion state (FIGS. 2B, 2F) and a solid state (FIGS. 3A, 3E). Alternative castellation assemblies exist in the art and can be substituted herein. For example, castellation assemblies having an external or other actuator acting on an actuation pin, such as a solenoid or mechanical toggle, can be used. An external fluid circuit can also control the castellation assembly such that control fluid is plugged to the pin bore 165 instead of routed through the rocker arm 101 in second hydraulic port 132. Pneumatic or hydraulic control can be used. So, while it is advantageous to route fluid pressure through the rocker arm 101, it is not the sole contemplated embodiment.

Figure 3B:
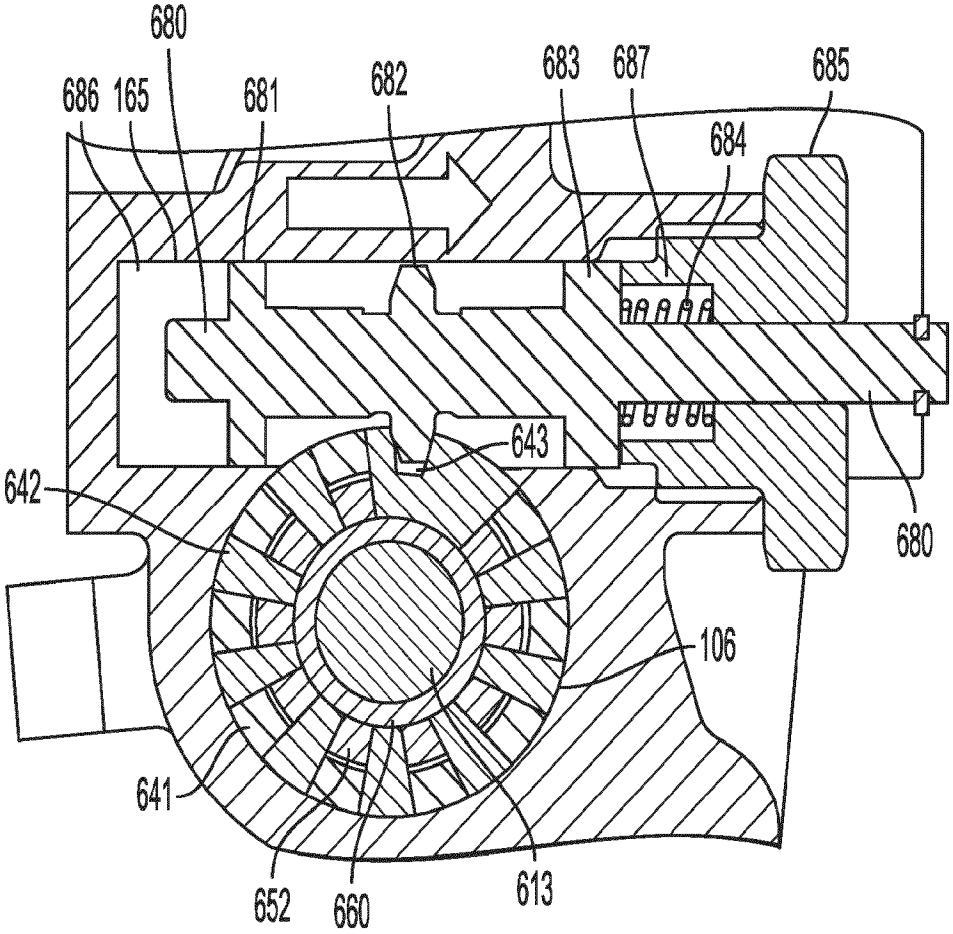
FIGS. 3A-3H illustrate aspects of brake modes.
Figure 3A:
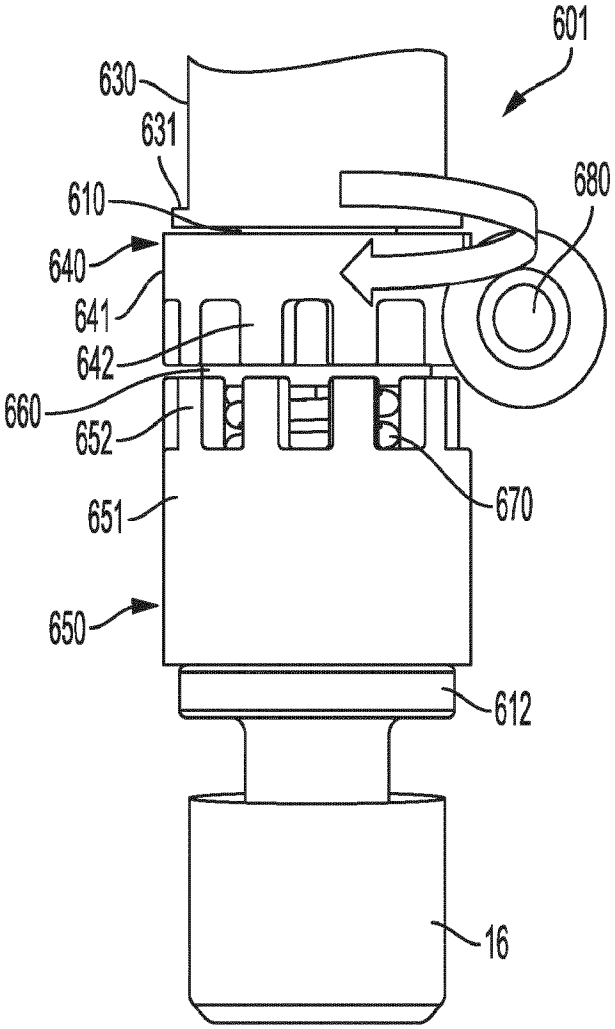

The hydraulically actuated castellation assembly 601 can comprise a castellation plunger 610 therethrough for connecting via a knurl 611 in footing 16 to cleat 14 in valve bridge 11. By switching from the lost motion state to the solid state, the castellation plunger 610 can be configured to push the cleat 14 in the pass-through 13 before any forces are imparted at footing 15. See FIG. 3D. second valve 21, the engine brake valve, can be opened before the first (main) valve 22. See FIG. 3F. Decompression engine braking can be achieved with the hydraulically actuated castellation assembly 601 in the solid state.

The solid state can be achieved by controlling an OCV to supply a high pressure fluid, such as an oil, to fluid path 8 in rocker shaft 7. Second hydraulic port 132 supplies the fluid to pin bore 165. An actuation pin 680 is situated in pin bore 165 so that the high pressure fluid 686 can push on a fluid rim 681 and thereby move the actuation pin 680. See FIG. 3B. A travel limit rim 683 moves towards a pin plug 685 and compresses pin spring 684 into plug cup 687. An actuation rim 682 is between the fluid rim 681 and travel limit rim 683. The actuation rim 682 is seated in an actuation groove 643 in an upper castellation 640. Upper teeth 642 project from an upper ring 641. The movement of the actuation rim 682 in the actuation groove 643 turns the upper teeth 642 to align with lower teeth 652 protruding from a lower ring 651 of a lower castellation 650. See FIG. 3A. The tooth-to-tooth alignment provides the solid state for the hydraulically actuated castellation assembly 601.

Figure 3C:
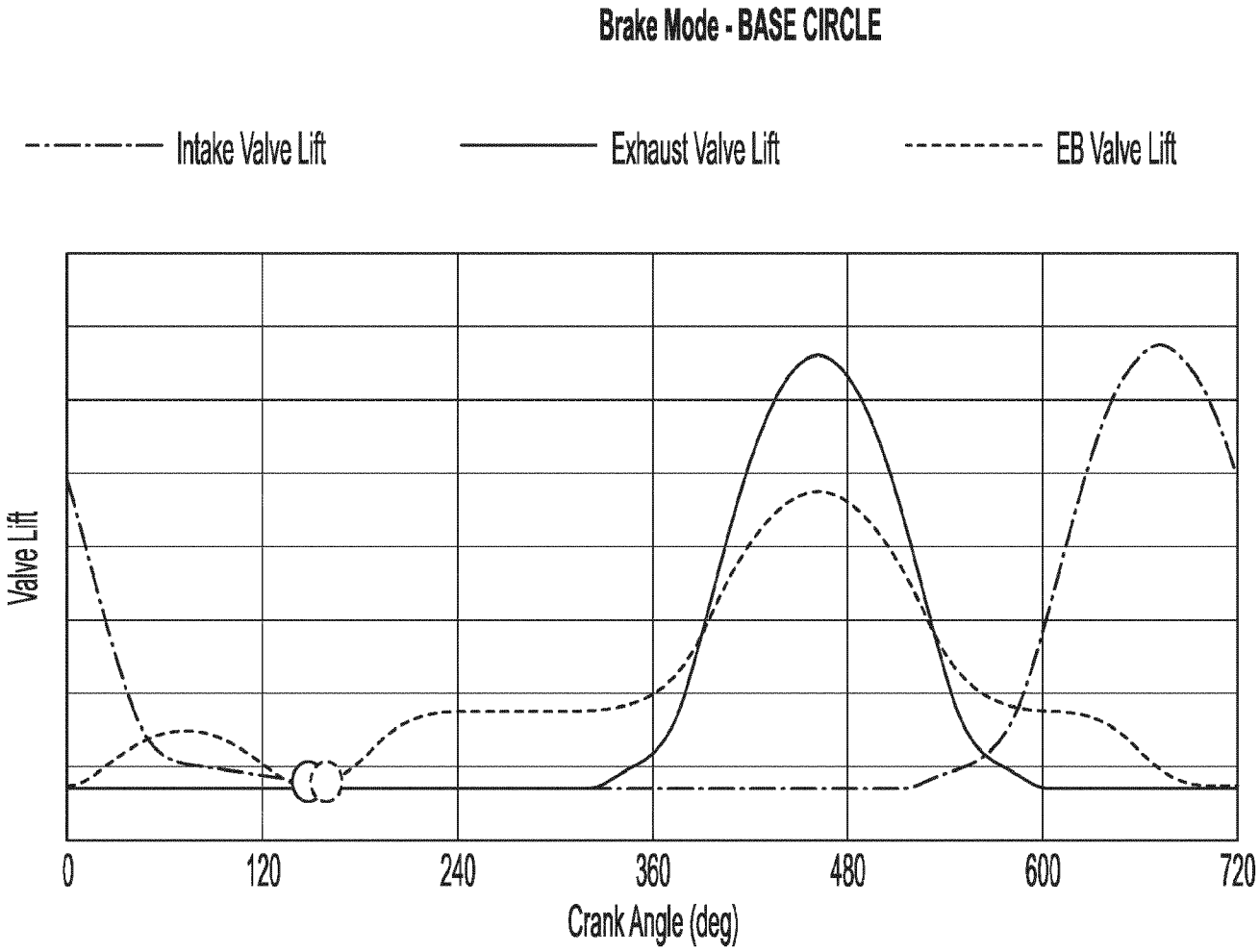
Figure 3E:
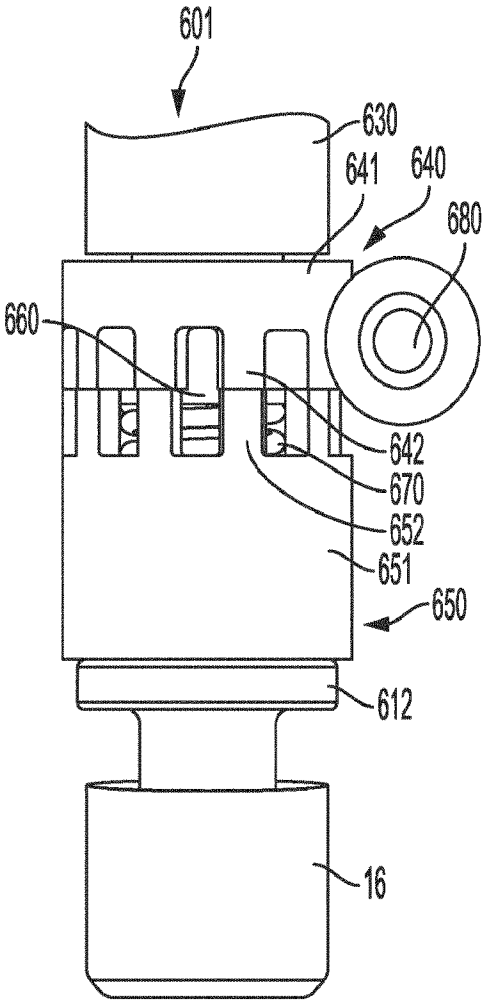
Figure 3D:
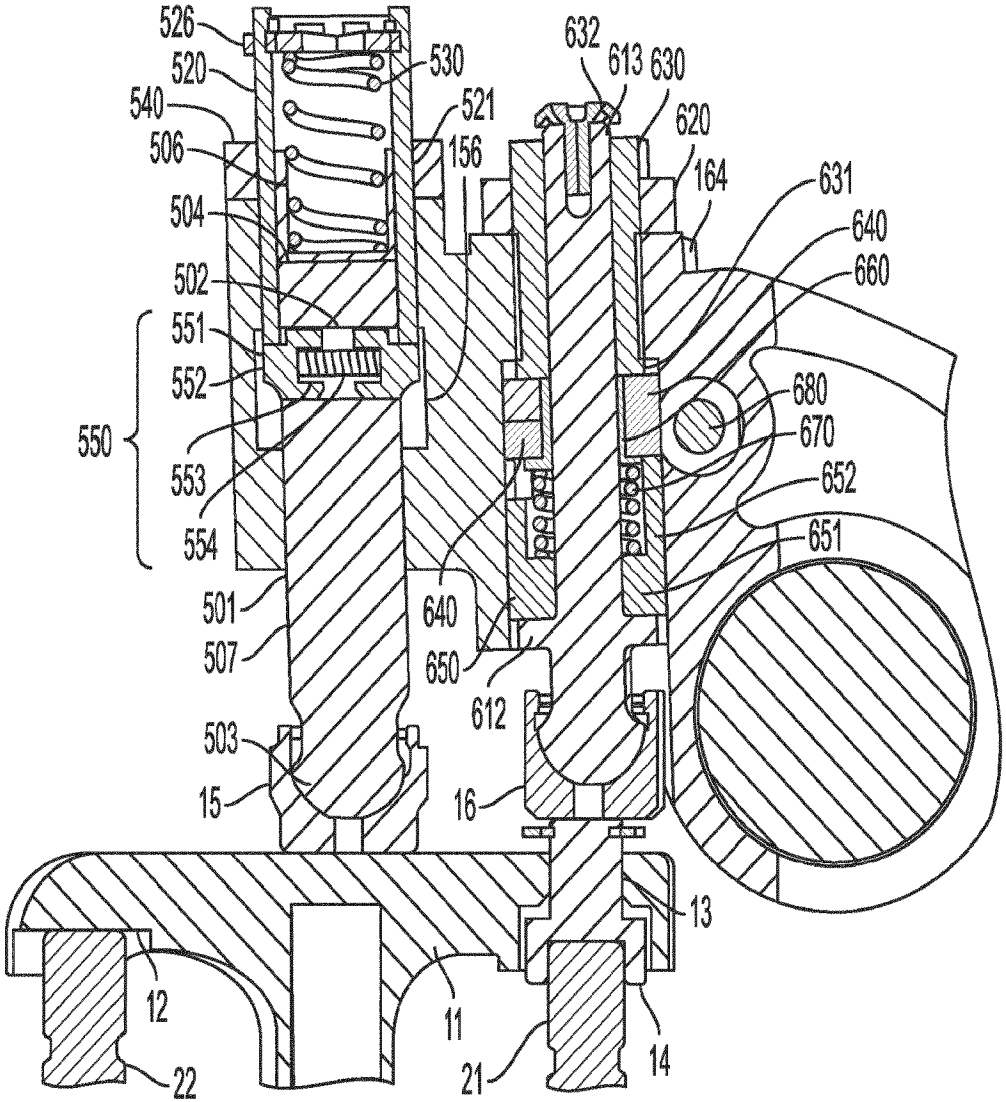
Figure 3F:
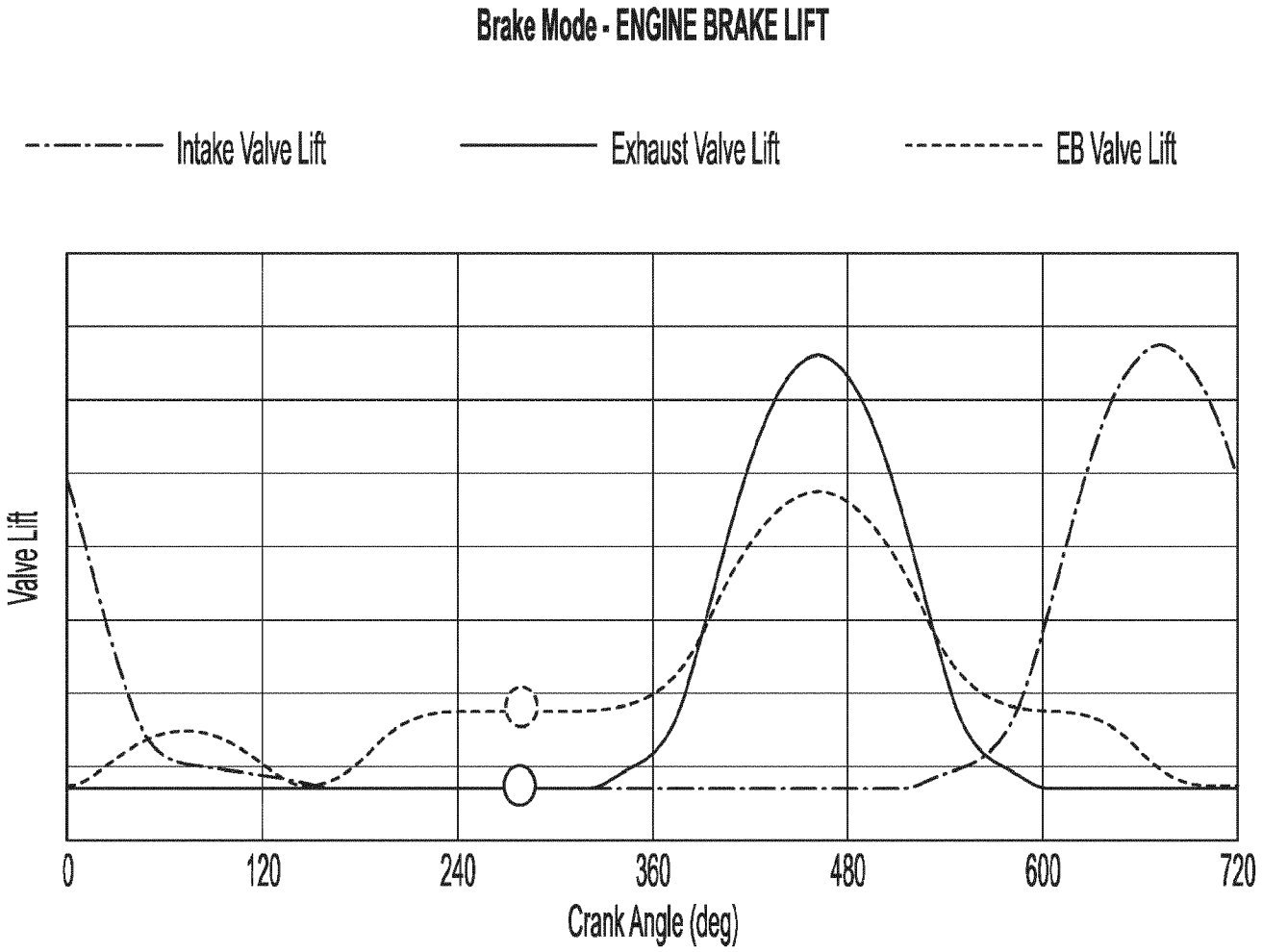

The tooth-to-tooth alignment can be selected while or near the cam 2 having base circle 3 aligned with the roller 112. FIG. 3C shows that both engine brake valve 21 and the main valve 22 have zero lift, so there should be little to no resistance to the movement of the upper castellation. With no force yet on the hydraulically actuated castellation assembly 601, the castellation spring 670 can push the spacer 660 and lift the upper castellation 640 for the ease of rotation shown in FIG. 3A. Then, when the cam rotates the lift lobe 4 into contact with the roller 112, the forces tilt the rocker arm 101 so that the castellation plunger 610 is first to act on the valve bridge 11. The engine brake function can be achieved, as in FIG. 3F, where the engine brake valve 21 is lifted but the main valve 22 is not lifted. The force presses the upper teeth 642 to contact the lower teeth 652, as shown in FIG. 3E. The castellation spring 670 is compressed, the plunger lip 612 is pushed upon, and the force from the lift lobe 4 is transferred to the cleat 14, as shown in FIG. 3D.

Figure 3G:
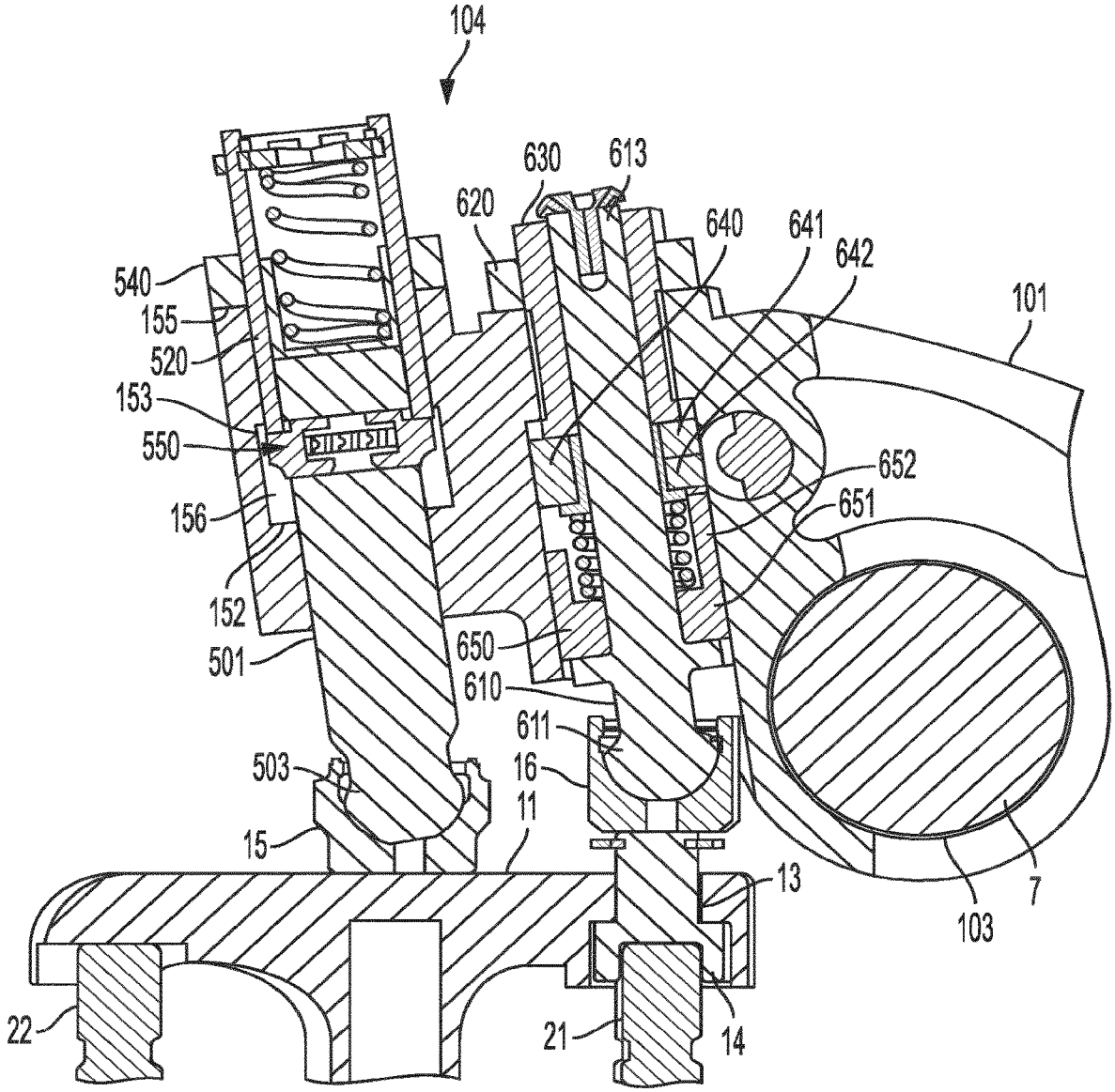
Figure 3H:
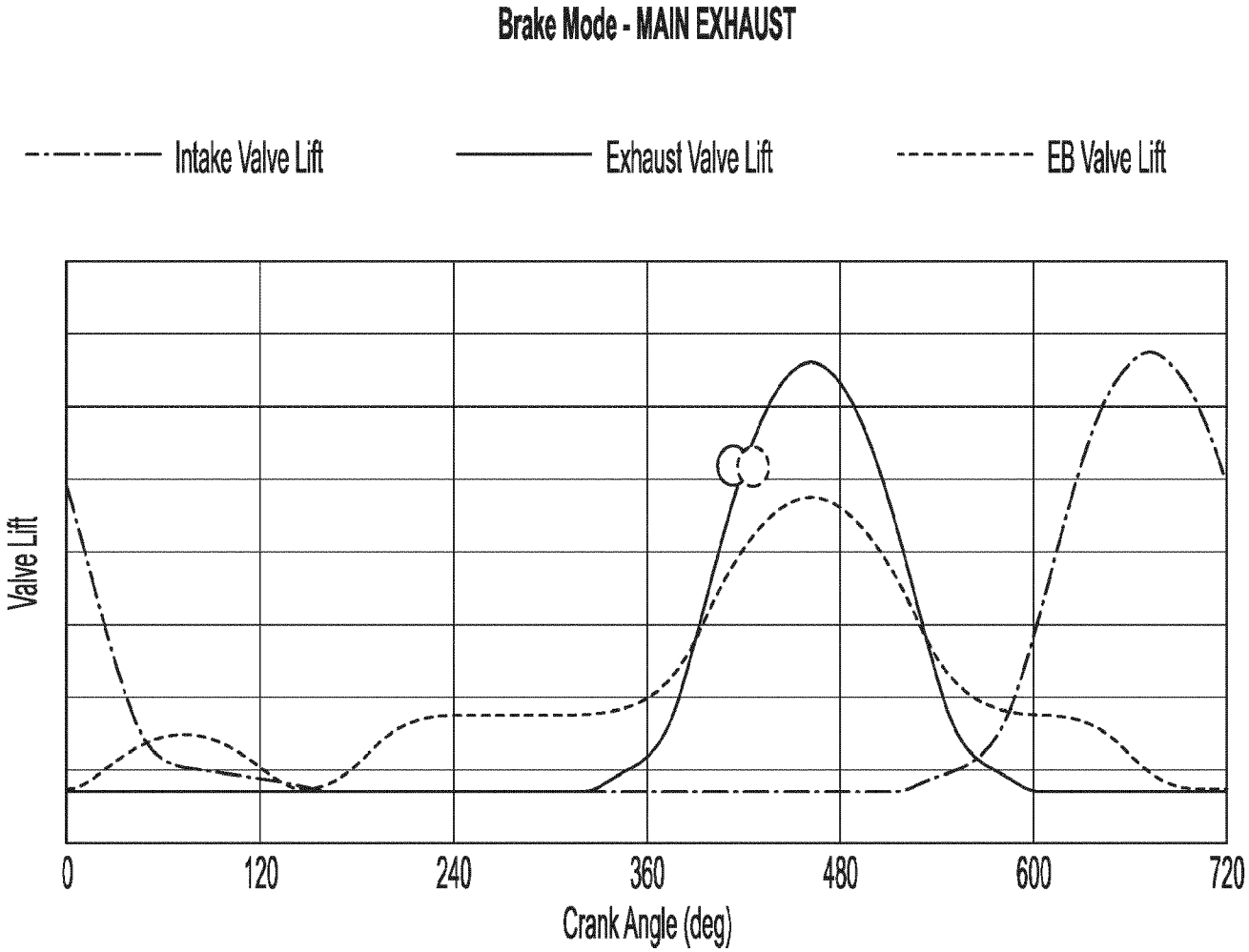

Eventually, the force from the lift lobe 4 tilts the rocker arm 101 so that CDA actuator 500 acts on the valve bridge 11, around 300-310 degrees in FIG. 3H. The rocker assembly 100 is such that the engine brake actuator 600 comprises the hydraulically actuated castellation assembly 601 configured to have already selectively switched from a lost motion state to the solid state, while the first actuator bore 105, comprising the travel stop 152 and the mechanical lash-setting sleeve 520 or latch step 153 distanced from the travel stop 152, is configured with the hydraulically actuated latch assembly 550 configured to travel in the travel bore 156 from the travel stop 152 to a position abutting the mechanical lash-setting sleeve 520 or latch step 153. See FIG. 3G. So, the hydraulically actuated latch assembly 550 is latched and the engine brake actuator 600 is in the solid state so that a main lift function can be imparted to both the engine brake valve 21 and main valve 22, as shown in FIG. 3H around 380 degrees. The engine brake valve 21 would have followed the dashed line path for EB valve lift but the CDA actuator 500 now controls the lift profile and both valves follow the exhaust valve lift solid line lift profile until about 540 degrees of crank angle.

As the cam 2 continues to rotate, the lift lobe 4 can transition to a degree of rotation where the main exhaust profile no longer applies to both of the valves 21, 22. Then, the main valve 22 can close, as shown by the solid line exhaust valve lift line in FIG. 3H around 600 degrees. The solid state still being applied to the hydraulically actuated castellation assembly 601, the EB valve lift dashed line shows that the engine brake valve 21 is still lifted open until about 710 degrees. It can be said that a late exhaust valve closing function has been applied to the engine brake valve 21. It can also be said that an early exhaust valve opening has been applied to the engine brake valve 21, for the engine brake valve 21 has been lifted open before the main valve 22. With an exhaust valve open at the same time as intake valves, internal exhaust gas recirculation ("iEGR") can be achieved.

The example is not restrictive. Other crank angles can be used so that other timings for opening and closing of valves can be achieved. Other variable valve actuation ("VVA") functionality can be achieved with appropriate selection of intake and exhaust valve pairings and cam lobe profiles. For example, two lift lobes 4 can be included on the cam 2, then two engine brake valve openings can be achieved. As shown in FIG. 3H, brake gas recirculation ("BGR") is accomplished at approximately zero to 130 degrees, a reset period occurs around 130-140 degrees, then compression release braking is achieved at approximately 140-350 degrees. Brake gas recirculation or internal exhaust gas recirculation ("iEGR") can be accomplished later in the cycle, at approximately 520-700 degrees. By adjusting the timings, early valve opening functions (EEVO or LEVO) or late valve closing functions (LEVC, LIVC) can be accomplished on either the intake or exhaust valves by configuring the rocker arm 101 on the appropriate half of the cylinder.

Several actuation functions can be achieved with the engine brake actuator 600 comprising the hydraulically actuated castellation assembly configured to selectively switch to the lost motion state from the solid state in the second actuator bore 106. Concurrent control of the hydraulically actuated latch assembly 550 configured in the first actuator bore 105 can be done to selectively control travel between the travel stop 152 and the mechanical lash-setting sleeve 520 or latch step 153 when the engine brake actuator 600 is in the lost motion state. These functions can include the cylinder deactivation function mentioned above for FIGS. 4A & 4B and can include various drive modes covered in FIGS. 2A-2J.

Discussed above were aspects of lash-setting for the mechanical lash-setting sleeve 520. Setting the travel distance of the hydraulically actuated latch assembly 550 in the travel bore 156 sets how much the rocker arm 101 can tilt before the CDA actuator 500 transfers force to the valve bridge 11. The travel distance is also related to how much engine brake lift can be applied to the engine brake valve 21 independent of the lift applied to the main valve 22. Yet another function, during the reset period, is providing space for the latch and unlatch of the hydraulically actuated latch assembly 550. And, another function is providing height for the switching of the hydraulically actuated castellation assembly 601. So, the CDA actuator 500 has room for latching and unlatching and the hydraulically actuated castellation assembly 601 has room for rotation of the upper and lower castellations 640, 650. An additional mechanism to create space for rotation of the upper and lower castellations 640, 650 is lash sleeve 630. Lash sleeve 630 can be threaded to threads in secondary bore 163. A lash nut 620 can also be used to lock the position of the lash sleeve 630. Lash nut 620 can thread to a top edge 164 of second actuator bore 106. By setting the position of the lash sleeve 630 in main bore 161, the extent to which the upper and lower castellations 640, 650 can separate can be set and the extent to which the rocker arm 101 can rotate before force is transferred through the hydraulically actuated castellation assembly 601 can be set. A lash sleeve lip 631 can optionally be included as another travel limit for the upper castellation 640, or an upper step 162 can be used as a travel limit in the second actuator bore 106, or both can be used.

In lost motion, the hydraulically actuated castellation assembly 601 has play along the castellation plunger 610. A travel limit pin 632 can be inserted at the top of the extended plunger body 613 so that the plunger 610 cannot drop through the hydraulically actuated castellation assembly 601. The lash sleeve can surround an upper portion of the extended plunger body 613. The upper castellation 640 can be pressed toward the lash sleeve 630 by the castellation spring 670. A spacer 660 can receive the spring force from castellation spring 670 and the upper castellation 640 can smoothly rotate on a rim of the spacer 660. The castellation spring 670 can press the lower castellation 650 away from the upper castellation 640, with the lip 612 of the plunger being biased towards the valve bridge 11 along with the lower castellation 650.

Figure 2A:
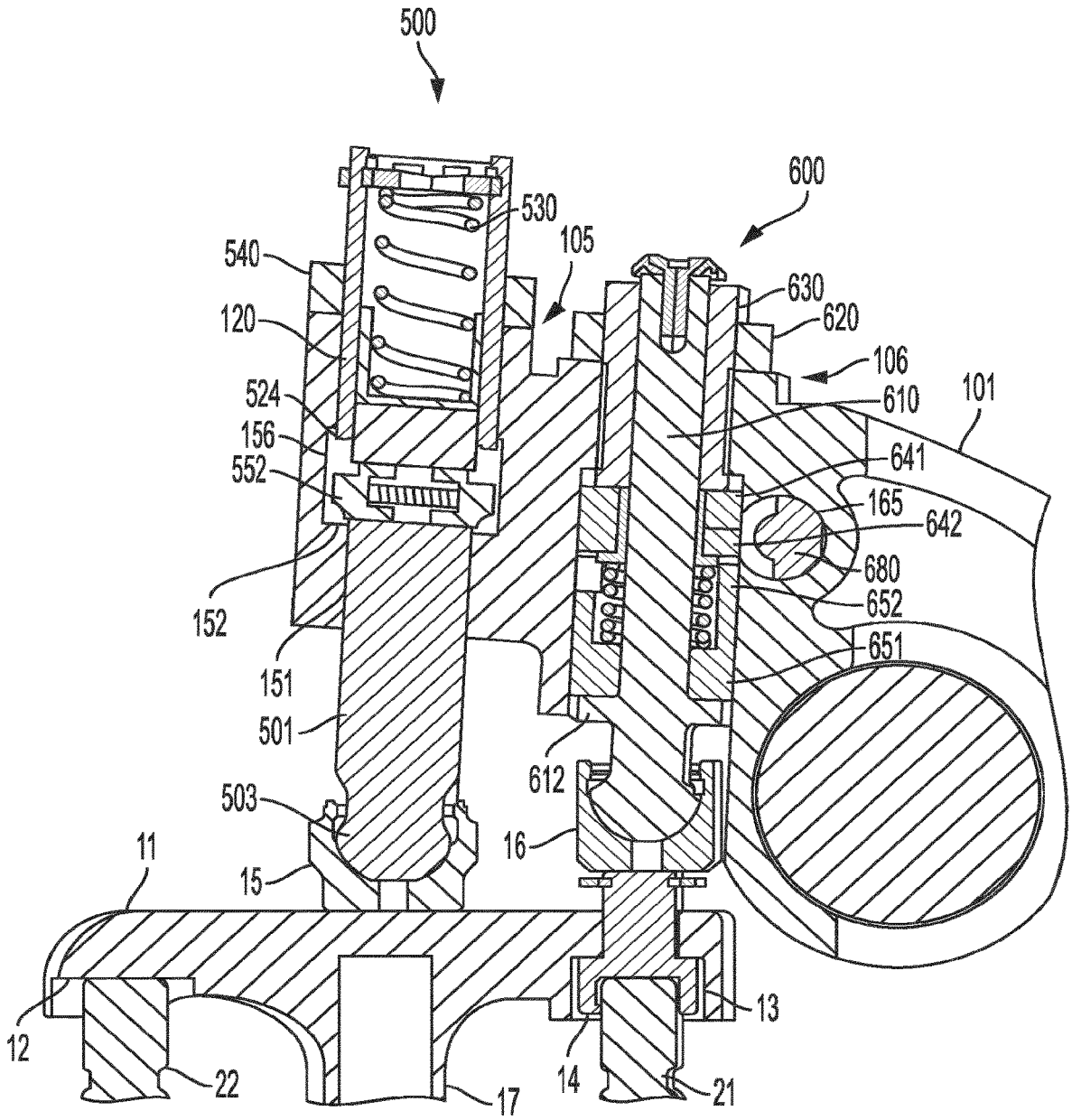
FIGS. 2A-2I illustrate aspects of drive modes.
Figure 2C:
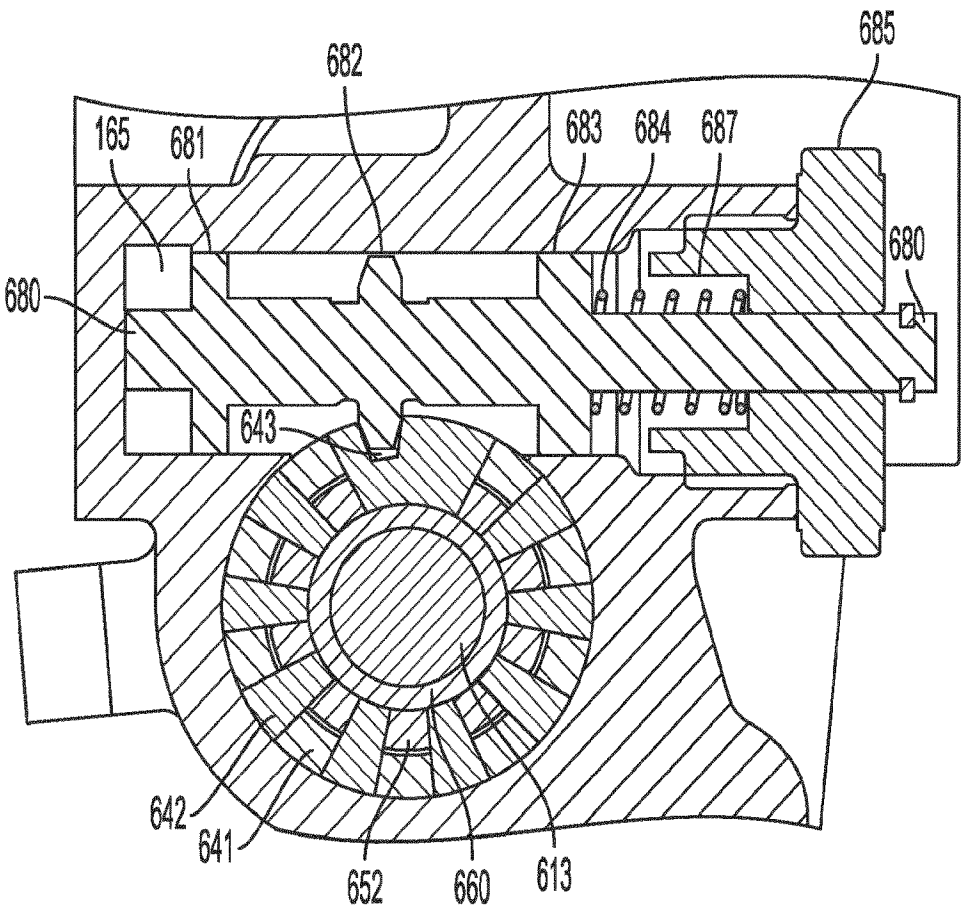
Figure 2B:
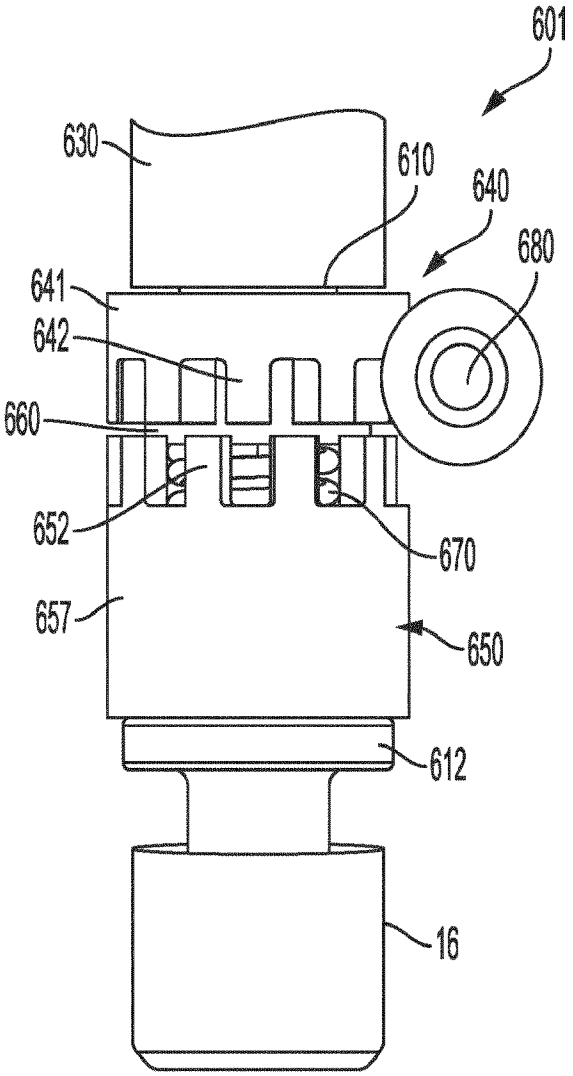
Figure 2D:
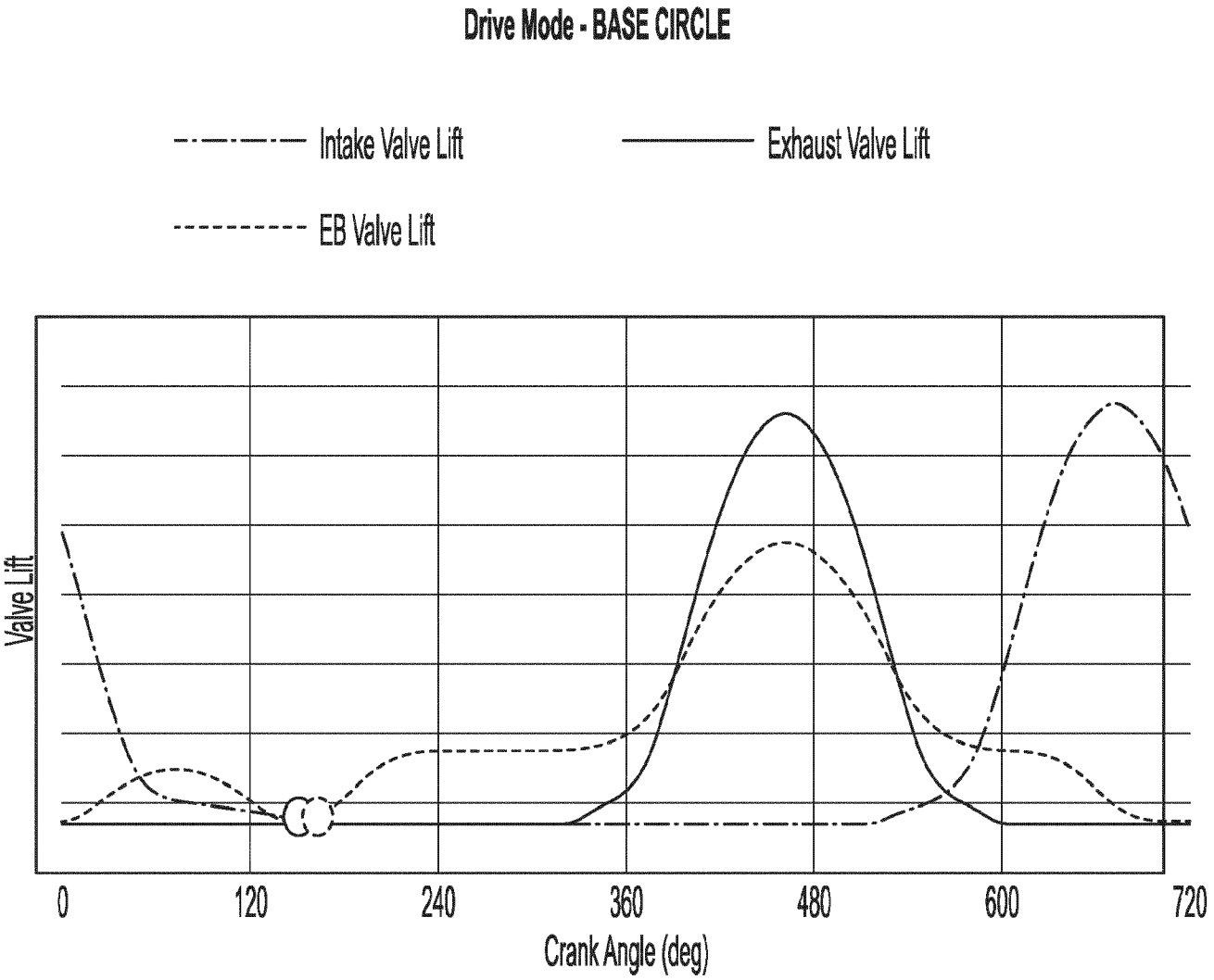

FIG. 2A shows the rocker arm 101 in drive mode with the cam 2 at base circle 3. The drive function begins with the hydraulically actuated latch assembly 550 abutting the travel stop 152 and with the upper and lower castellations 640, 650 separated by a gap. The gap can also be seen in FIG. 2B. In FIG. 2C, the actuation rim 682 of actuation pin 680 is pushed away from the pin plug 685, there is low or no fluid pressure on the fluid rim 681, so the upper castellation 640 is positioned with the upper teeth 642 aligned between the lower teeth 652. At this location in the crank angle, the reset position around 130 degrees, neither exhaust valve 21, 22 has any lift.

Figure 2F:
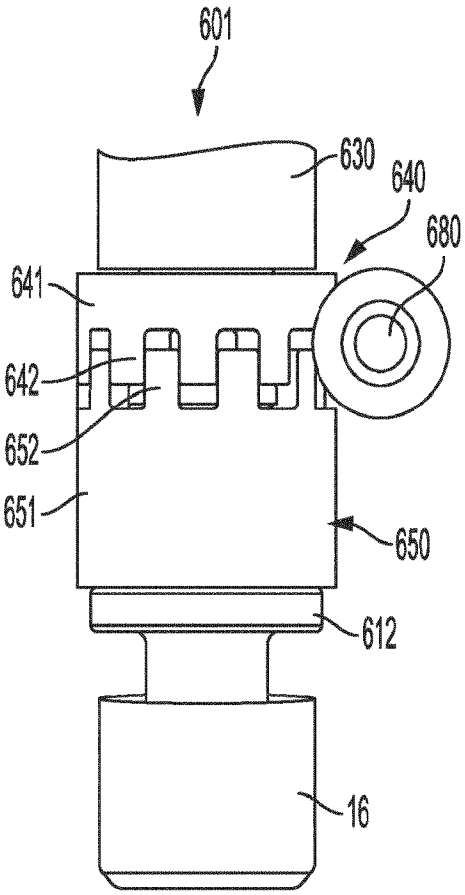
Figure 2E:
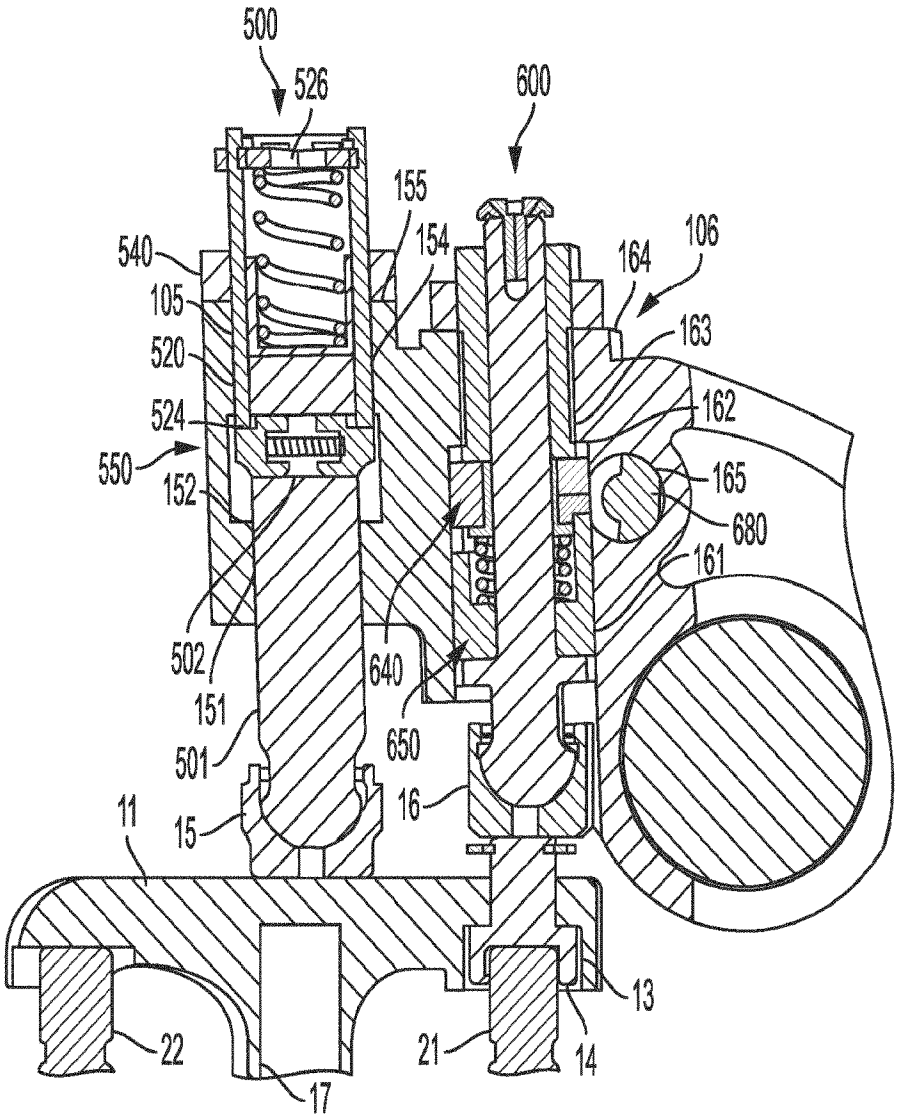
Figure 2G:
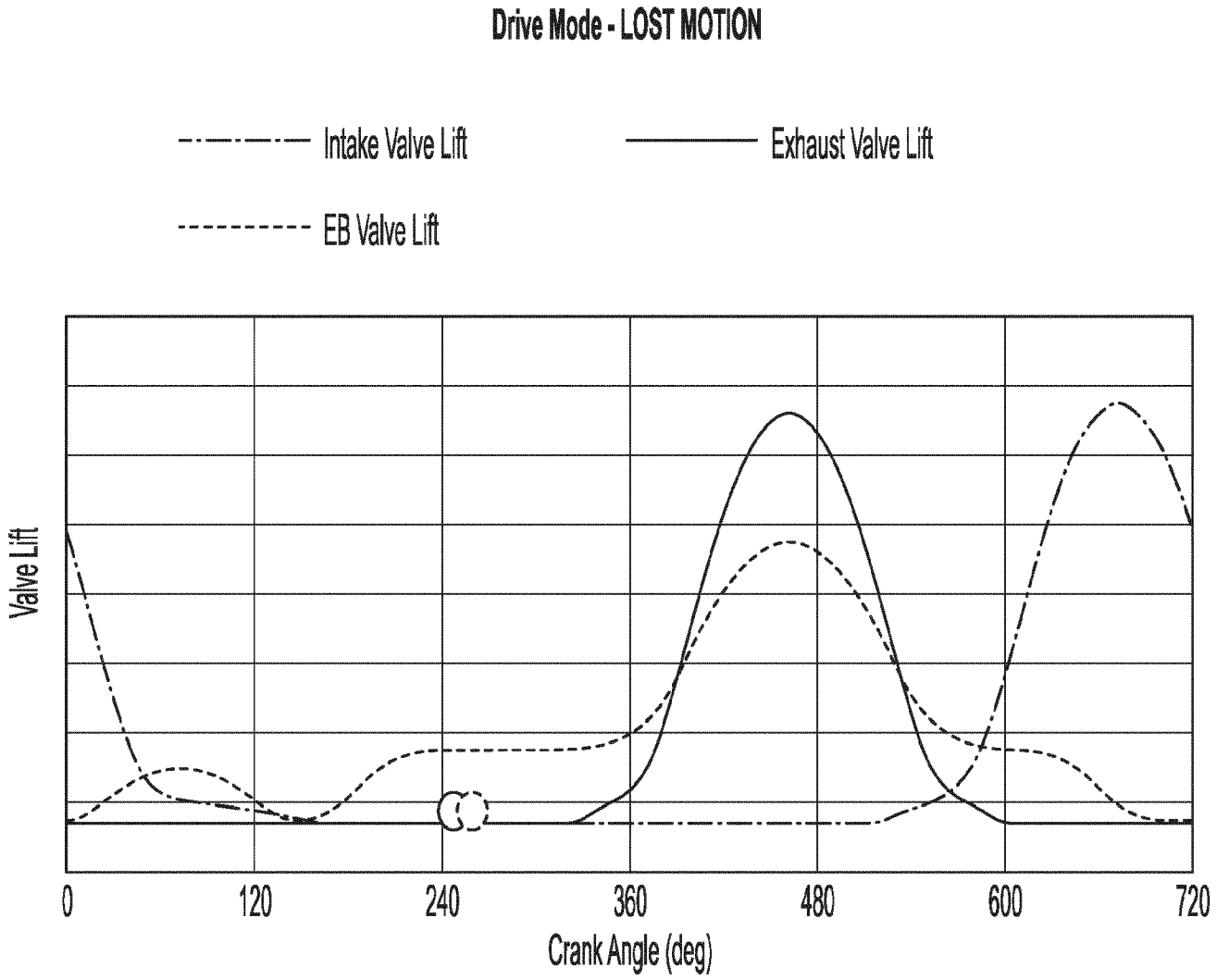
Figure 2H:
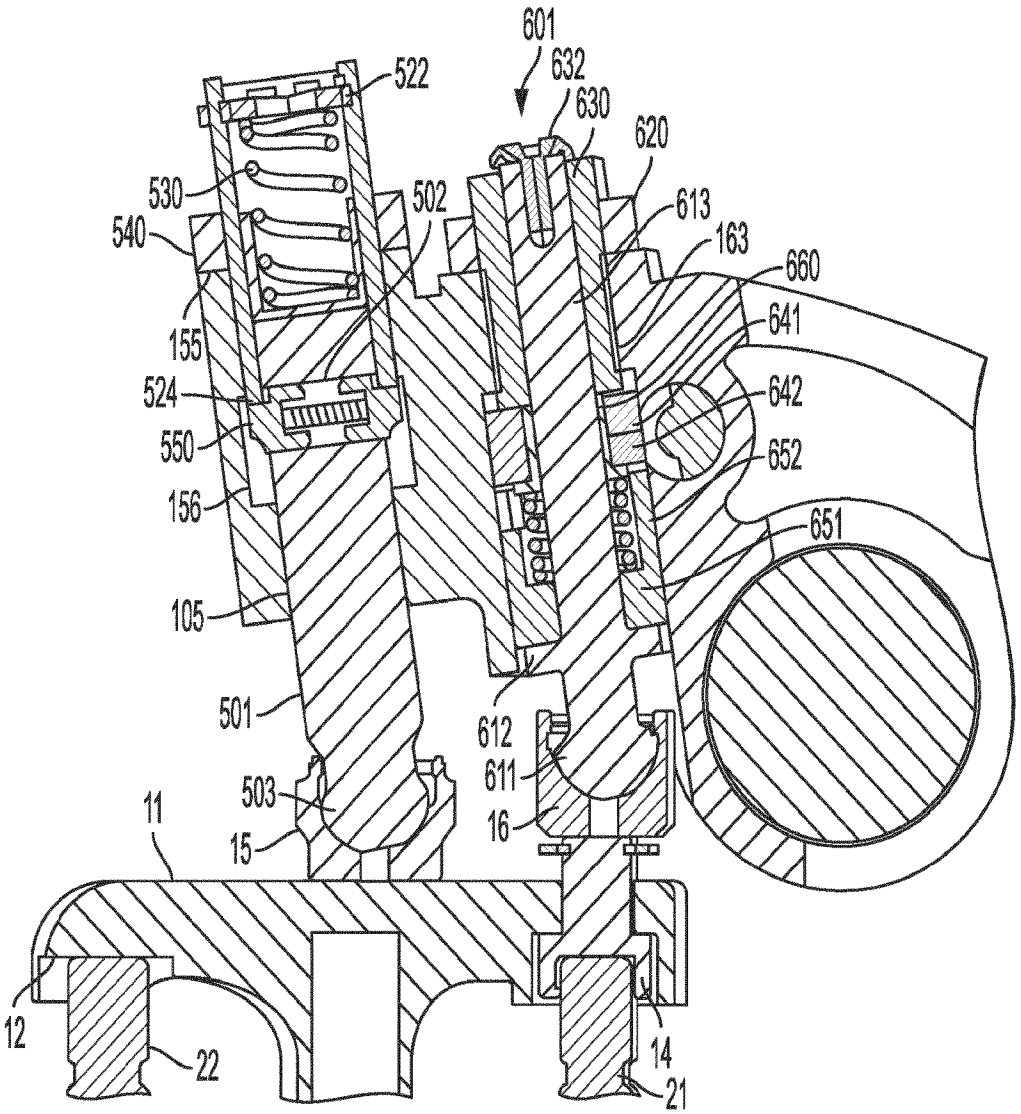
Figure 2I:
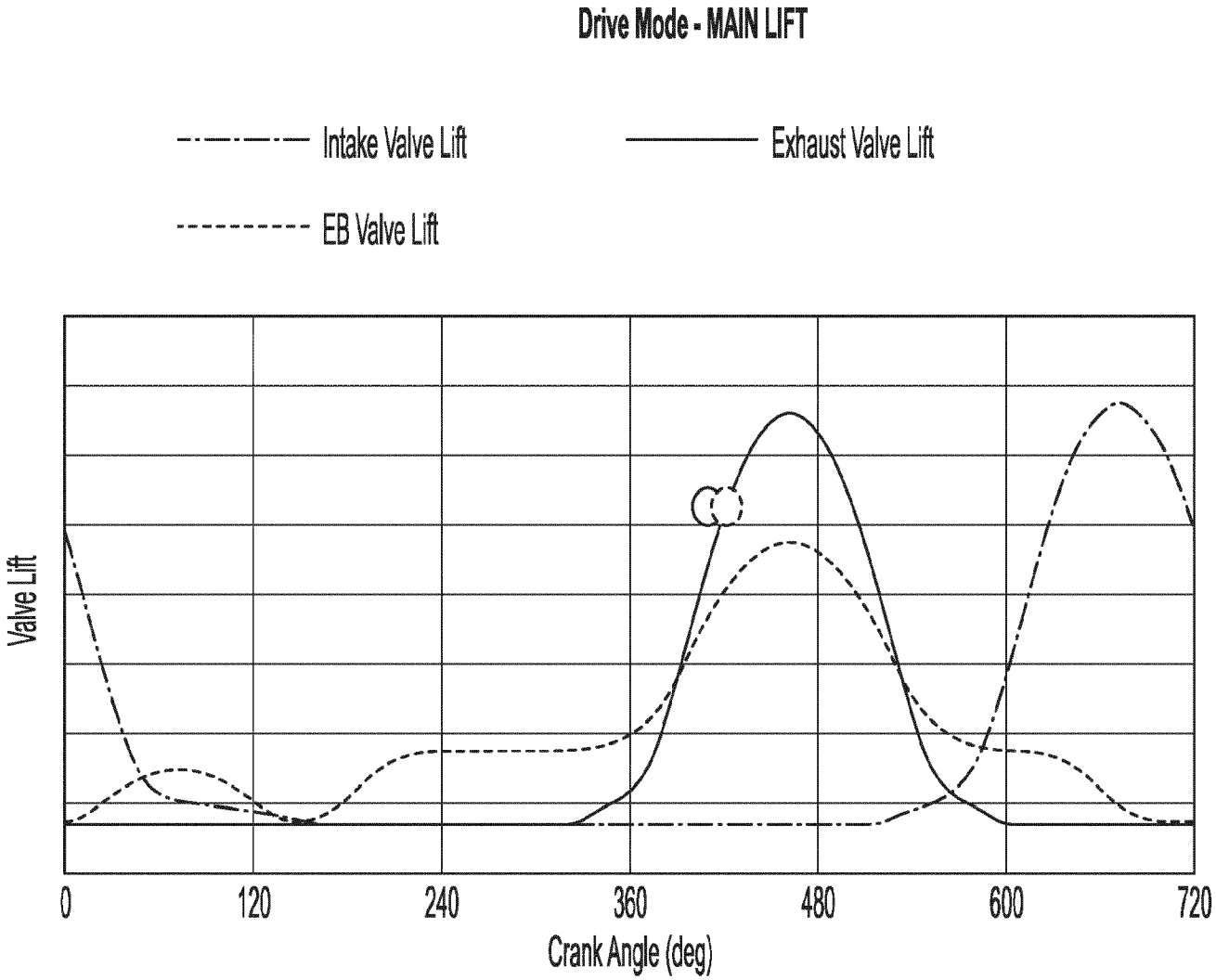

As the cam 2 rotates along the one or more lift lobe 4, the rocker arm 101 tilts, as seen in FIGS. 2E & 2F. The hydraulically actuated latch assembly 550 travels in the travel bore from the travel stop 152 to abut either the latch end 524 of the mechanical lash-setting sleeve 520 or the latch step 153 of the first actuator bore 105. The upper and lower castellations 640, 650 move together also, in lost motion, so that no force is transferred to the cleat 14 independent of the force applied to the valve bridge at footing 15. The engine brake valve 21 does not open independent of the main valve 22. The valves 21, 22 move together because of the lost motion. The dashed EB valve lift line in FIG. 2G is lost in the motion of the upper and lower castellations 640, 650. As the circles indicated, the valves 21, 22 travel together along the exhaust valve lift solid line in FIG. 2G. FIGS. 2H & 2I show the main lift function in drive mode in more detail, with the knurls 503 & 611 rotated in their footings 15, 16 and the rocker arm 101 tilted. FIG. 2I shows by the joined circles that both engine brake valve 21 and main valve 22 are traveling along the solid line exhaust valve lift line while the EB valve lift is not followed by either valve 21, 22. The intake valve lift is also shown for reference.

Consistent with the disclosure, a valve assembly 10 can be configured to comprise a valve bridge 11, a second valve 21 coupled to the valve bridge 11, a second valve 21 coupled to a cleat 14 in a pass-through 13 in the valve bridge 11. A rocker assembly 100 can comprise a solid state engine brake actuator 600 coupled via the cleat 14 to the second valve 21 to impart an engine braking function to the second valve 21. The cylinder deactivation actuator 500 can be coupled to the valve bridge 11 to impart a main lift function to both the first valve 22 and the second valve 21.

Also consistent with the disclosure, a valve assembly 10 can comprise the cylinder deactivation actuator 500 coupled to the valve bridge 11 to impart a main lift function to both the first valve 22 and the second valve 21 when the engine brake actuator 600 is in the lost motion state and when the hydraulically actuated latch assembly 550 is latched.

Also consistent with the disclosure, a valve assembly 10 can comprise the engine brake actuator 600 comprising a hydraulically actuated castellation assembly configured to selectively switch between a lost motion state and a solid state. The configuration can impart no valve lift transferred to the first valve 22 or to the second valve 21 when the hydraulically actuated latch assembly 550 is unlatched and the hydraulically actuated castellation assembly 601 is in the lost motion state.

Consistent with the disclosure, a valvetrain 1 can be configured comprising a rotating cam 2, a rocker shaft 7, and the valve assembly 10 mounted to receive actuation forces from the rotating cam 2. The engine brake actuator 600 can impart an early exhaust valve opening function ("EEVO") and a late exhaust valve closing function ("LEVC") to the second valve 21 in addition to the engine braking function.

Additionally, the valvetrain 1 can be configured so that no valve lift function is transferred from the rotating cam 2 to the first valve 22 or to the second valve 21 when the hydraulically actuated latch assembly 550 is unlatched and when the hydraulically actuated castellation assembly 601 is in the lost motion state.

Other implementations will be apparent to those skilled in the art from consideration of the specification and practice of the examples disclosed herein.

The invention claimed is:

1. A rocker assembly for a type III center pivot valvetrain, the rocker assembly comprising:

a rocker arm comprising a cam end, a center pivot bore, and a valve end which includes a first actuator bore and a second actuator bore;

a cylinder deactivation actuator arranged in the first actuator bore, the cylinder deactivation actuator comprising:

a hydraulically actuated latch assembly configured to selectively switch between a latched configuration and an unlatched configuration;

a mechanical lash-setting sleeve distanced from a travel stop defined within the first actuator bore; and a latch step disposed below the mechanical lash-setting sleeve and extending into the first actuator bore; and an engine brake actuator arranged in the second actuator bore, wherein the hydraulically actuated latch assembly is further configured to selectively travel between the travel stop and the latch step when the hydraulically actuated latch assembly is in the latched configuration.

2. The rocker assembly of claim 1, further comprising a first hydraulic port connected from the center pivot bore to the first actuator bore and a second hydraulic port connected from the center pivot bore to the second actuator bore.

3. The rocker assembly of claim 2, wherein the engine brake actuator comprises a castellation assembly configured to selectively switch between a lost motion state and a solid state.

4. The rocker assembly of claim 1, further comprising a spring biasing a plunger in a direction out of the mechanical lash-setting sleeve, wherein the hydraulically actuated latch assembly is seated in the plunger.

5. The rocker assembly of claim 1, wherein the hydraulically actuated latch assembly is further configured to selectively travel between the travel stop, past the latch step, and into the mechanical lash-setting sleeve when the hydraulically actuated latch assembly is in the unlatched configuration.

6. A valve assembly comprising:

the rocker assembly of claim 5;

a valve bridge;

a first valve coupled to the valve bridge; and a second valve coupled to a cleat in a pass-through opening of the valve bridge, wherein the engine brake actuator is coupled to the second valve via the cleat, the engine brake actuator comprising a castellation assembly configured to selectively switch between a lost motion state and a solid state, and wherein no valve lift is transferred to the first valve or to the second valve when the hydraulically actuated latch assembly is in the unlatched configuration and the castellation assembly is in the lost motion state.

7. The rocker assembly of claim 1, wherein the engine brake actuator comprises a castellation assembly configured to selectively switch between a lost motion state and a solid state, and wherein the hydraulically actuated latch assembly is further configured be in the latched configuration when the castellation assembly is in the lost motion state.

8. A valve assembly, comprising:

the rocker assembly of claim 7;

a valve bridge;

a first valve coupled to the valve bridge; and a second valve coupled to a cleat in a pass-through opening of the valve bridge, wherein the cylinder deactivation actuator is configured to impart a main lift function to the first valve and the second valve via the valve bridge when the castellation assembly is in the lost motion state and the hydraulically actuated latch assembly is in the latched configuration.

9. The rocker assembly of claim 1, wherein the engine brake actuator comprises a castellation assembly configured to selectively switch between a lost motion state and a solid state and wherein the hydraulically actuated latch assembly is further configured to abut the latch step when the hydraulically actuated latch assembly is in the latched configuration and the castellation assembly is in the solid state.

10. A valve assembly, comprising:

the rocker assembly of claim 9;

a valve bridge;

a first valve coupled to the valve bridge; and a second valve coupled to a cleat in a pass-through opening of the valve bridge, wherein the engine brake actuator is configured to impart an engine braking function to the second valve via the cleat when the castellation assembly is in the solid state, and wherein the cylinder deactivation actuator is configured to impart a main lift function to the first valve and the second valve via the valve bridge when the hydraulically actuated latch assembly is in the latched configuration.

* * * * *